United States Patent [19]

Bonaiti

[11] 4,055,310

[45] Oct. 25, 1977

[54] TAPING DEVICE IN COIL WINDERS

[75] Inventor: Francesco Bonaiti, Saronno (Varese), Italy

[73] Assignee: Tekma Kinomat S.p.A., Caronno Pertusella, Italy

[21] Appl. No.: 486,681

[22] Filed: July 8, 1974

[51] Int. Cl.[2] ..... H01F 41/12

[52] U.S. Cl. ..... 242/7.08; 242/7.09; 242/7.15

[58] Field of Search ..... 242/7.08, 7.14, 6, 7.03, 57/10, 13, 18

[56] References Cited

U.S. PATENT DOCUMENTS

| | | | |
|---|---|---|---|
| 2,507,589 | 5/1950 | Ciambrone et al. | 57/18 |
| 2,688,450 | 9/1954 | Bell | 242/7.08 |
| 3,263,309 | 8/1966 | Carman et al. | 242/7.14 X |

FOREIGN PATENT DOCUMENTS

| | | | |
|---|---|---|---|
| 532,151 | 10/1956 | Canada | 242/7.08 |

*Primary Examiner*—Billy S. Taylor
*Attorney, Agent, or Firm*—Young & Thompson

[57] ABSTRACT

Device for winding and applying a tape, particularly an adhesive tape, around the coil kept fixed in a coil winding machine, of the type comprising a support table to rotate about a fixed coil and carrying a reel of feed tape, comprising means for pivoting the reel of tape, first guide means for guiding the tape in strict proximity of the fixed body in a plane parallel to the winding axis, second guide means disposed at a short distance from the first guide means and in a position such that the tape unwinds between the first and second guide means along a first path substantially perpendicular to the winding axis, said second guide means being arranged to deviate the tape along a second path which withdraws from the coil and which forms an angle which may be as small as desired, even zero, to the winding axis, the pivoting means for the reel of tape being aligned with the second path.

11 Claims, 8 Drawing Figures

A
B
C
D
E
F
0°
23°
160°
172°
194°
223°
360°

B
15
39
40
41
44
44A
45
46
50
51
52
53
54
55
56
57
59
60
60'
61
62
63
65
66
67
68
69
70
34
35
F11

TAPING DEVICE IN COIL WINDERS

BACKGROUND OF THE INVENTION

1. Field of the Invention

This invention relates to a taping device, i.e. a device capable of fixing a tape, for example a self-adhesive tape, completely around a body kept fixed, and in particular around the periphery of a coil formed in a coil winding machine.

2. Description of the Prior Art

In coil winding machines with a fixed wire guide and rotating coil, the taping problem is extremely simple. A reel of tape mounted on a fixed axis, parallel to the axis of the coil, feeds the tape to the coil around which it is wound by the rotation of the coil itself.

The problem becomes more difficult when taping is to be carried out on fixed coils. In this case a solution is generally adopted in which the reel of tape is again disposed on an axis parallel to the coil axis, but this axis is made to rotate about the coil axis. By operating in this manner, the tape, one end of which is held on the coil, is progressively laid on the coil itself during rotation, and simultaneously unwinds from the reel. However this arrangement has the disadvantage of requiring considerable free space around the coil to allow rotation of the reel of tape. In coil winding machines of the turret type, this disadvantage becomes more serious because it means that considerable space is occupied in the circumferential direction, i.e. a relatively extensive circular sector of the turret, so taking up a space which is vital for other devices which have to operate on the coil.

In order to obtain a reasonably limited pitch in the turret, so as to increase the number of operations which can be automatically carried out on the coils while at the same time avoiding a turret of excessive diameter, the general tendancy is to limit as far as possible the tangential or circumferential bulk of the operational devices associated with the turret, and allow the bulk instead to increase in the radial direction. However, taping devices which satisfy this requirement have not yet been proposed.

SUMMARY OF THE INVENTION

This problem is brilliantly solved by the device according to the present invention, which has precisely the advantage of a drastically reduced tangential bulk, especially in the position of application of the tape on the coil, while its extension is essentially in the radial direction. This device comprises first guide means very close to the coil for guiding the tape in a plane parallel to the coil axis and tangential to the coil periphery, second guide means at a short distance from the first means, lateral to the coil, for deviating the tape to a feed path which is substantially radial with respect to the turret axis, pivoting means for the reel of tape disposed in substantial alignment with said path, and a support common to said first and second guide means and to said pivoting means, said common support being mounted rotatable about the coil axis.

According to a preferred embodiment, said second guide means consists of at least one transmission roller mounted rotatable about an axis perpendicular to the coil axis, the tape undergoing a 90° twist about its own axis during its travel between said first and second guide means, while along said feed path the tape slides in a plane substantially parallel to the coil axis.

According to a further embodiment, said second guide means consists of a fixed, at least partially cylindrical slidable surface, the axis of which is positioned substantially as the bisecting line of the angle complementary to the angle formed between the direction of sliding of the tape along said feed path and along the path between said first and second guide means respectively, along both these paths the tape sliding on flat surfaces.

BRIEF DESCRIPTION OF THE DRAWINGS

Further characteristics and advantages of the present invention will be evident from the following description of some embodiments of the invention, given by way of example and illustrated in the accompanying drawings, in which.

DESCRIPTION OF THE PREFERRED EMBODIMENTS

Figures 1, 2, 8:
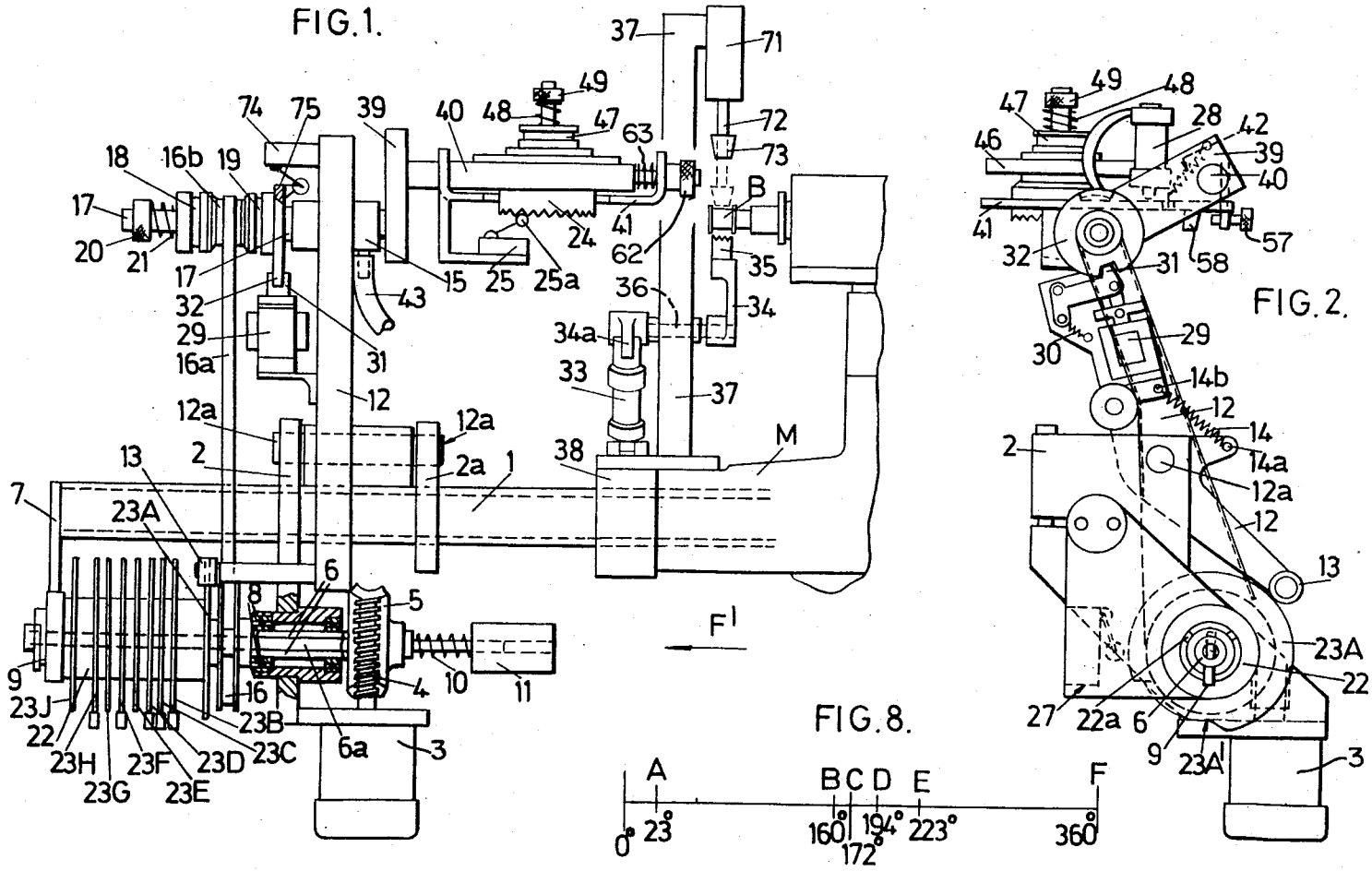
FIG. 1 is a diagrammatic side view of the taping device according to the invention, with parts broken away for clarity, fixed on a stepwise rotatable turret coil winding machine, of this latter there being shown only that part which supports the device.
FIG. 2 is a diagrammatic side view of the same device, seen along the arrow F' of FIG. 1.
FIG. 8 is an operating diagram.

As shown, the device according to the invention is mounted on a very thick tubular arm 1, which projects radially from the fixed base M of a coil winding machine. This device comprises a plate 2 mounted on the arm 1, and supporting the self-braking motor 3. The shaft of this latter rotates a worm 4 engaged with a gear 5, which transmits motion to the shaft 6. This latter is rotatably mounted at one end on the plate 7 also rigid with the arm 1, and at the other end on the plate 2 by way of bearings 8.

The shaft 6 is tubular and in its interior is mounted a second spindle **6*a*, which is axially slidable but is not rotatable with respect to the shaft 6. To that end of the spindle 6*a* opposite the gear 5 is fixed a radial pin 9, which selectively engages in an axial slot in the shaft 6**, and so acts as a key.

At its opposite end, the spindle **6*a* is subjected to the action of a spring 10, which tends to move it towards the right of the drawing, and to the action of an electromagnetic unit 11 which, when energised, tends to move it towards the left, in the direction indicated by the arrow F', selectively to engage and disengage pin 9 in and from said slot in shaft 6**, respectively.

On the shaft 6 is also mounted a drum 22, in a rotatable but not axially slidable manner, and on it are keyed various disc cams 23, the purpose of which will be better illustrated hereinafter.

The left hand end (with respect to FIG. 1) of the drum 22, opposite the gear 5, is provided with three notches **22*a*, disposed at 120° to each other, in one of which engages the aforementioned pin 9 in the manner of a key, so enabling the drum 22 to be driven by the shaft 6**.

A support arm 12 is swingably mounted on the pivot 12*a*, which is supported at one end on the plate 2 and at the other end on the plate 2*a*, also fixed to the tubular arm 1.

The arm 12 carries at its lower end a roller 13 which rests against the contour of the first cam 23A. The contact between the roller 13 and the cam 23A is ensured by the spring 14, which is fixed at 14*a* to the plate 2 and at 14*b* to the arm 12, and tends to make the arm 12 swing in the clockwise direction with respect to FIG. 2.

Figures 3, 4, 5, 6, 7:
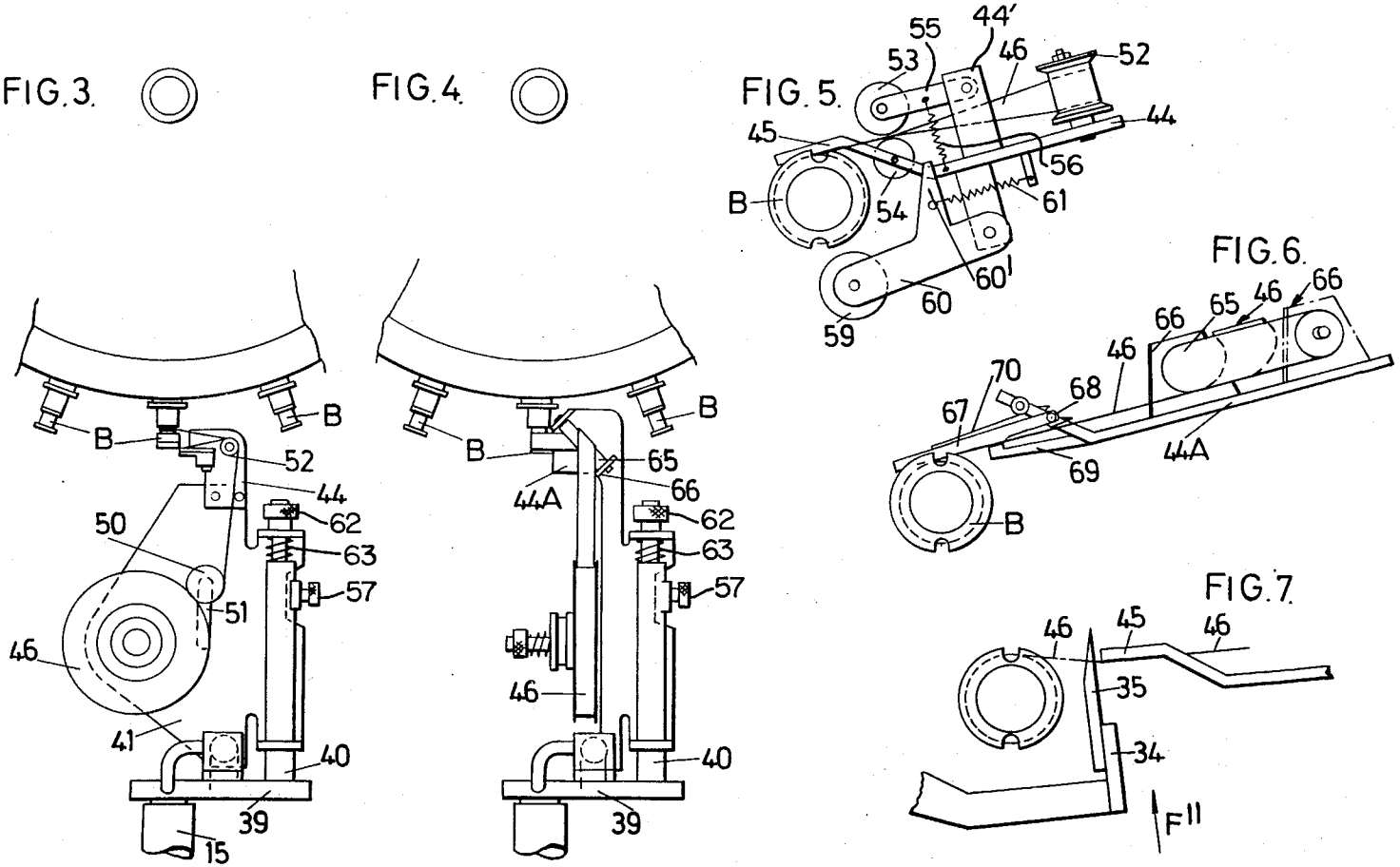
FIG. 3 is a plan view of the same device.
FIG. 4 is a plan view, analogous to FIG. 3, of a further embodiment of the taping device.
FIGS. 5 and 6 are a detailed view to an enlarged scale of a unit for applying the tape to the coil in an advanced working position, with relation to the embodiment of FIG. 3 and that of FIG. 4 respectively.
FIG. 7 is a diagrammatic view of the unit of FIGS. 5 or 6 in the withdrawn position, in which the tape is cut.

At the upper end of the arm 12 is mounted a bush 15, in which the shaft 17 is rotatably supported. The arm 12, under the control of the cam 23A, can swing between two positions, namely a working position, as shown in FIGS. 2, 3 and 4, in which the axis of the shaft 17 coincides with the axis of the coil (not shown) on which the taping operation is to be carried out, and a rest position, in which the tape can be cut, in this latter position the arm 12 being further rotated in the clockwise direction with respect to FIG. 2, while the roller 13 is engaged in the cavity 23A' of the cam 23A.

On the shaft 6 is also mounted a pulley 16, which transmits its motion to the belt 16*a*, preferably a toothed belt, and thus to the pulley 16*b*. This latter is mounted on the shaft 17, and is made rigid with the shaft by a pair of friction discs 18, 19, the action of which can be calibrated by a setting nut 20 and the pressure spring 21.

On the support arm 12 is also mounted an electromagnetic unit 29 which, when energised, acts on the latch 31, to make it swing in the clockwise direction (with respect to FIG. 2) against the action of the spring 30, so as to disengage its tooth from a stop notch provided in the periphery of the disc 32, keyed on to the shaft 17. By means of this construction, even when the belt 16*a* is moved, the shaft 17 is kept locked against rotation, together with the disc 32, until the tooth of the latch 31 is removed from said notch in the disc 32, which is possible because of the sliding of the friction discs 18, 19.

The device also comprises an arm 39 rigid with one end of the shaft 17, rotatable in the bush 15. A pivot 40 is fixed at one end to the arm 39 and projects from it parallel to the axis of the shaft 17. The rotation of the arm 39 with the shaft 17, the axis of which coincides with the axis of the coil B on which the taping operation is to be carried out, makes the pivot 40 describe a cylindrical surface which encloses the coil.

A plate 41 is swingably mounted on the pivot 40. This plate can make a small movement in the anticlockwise direction (with respect to FIG. 2) under the control of the cylinder 28, so as to move into the working position, and in the clockwise direction, to return to the rest position, under the action of the return spring 42. As the cylinder 28 is rigid with the arm 39 and rotates with it, the compressed air fed through the pipe 43 is introduced into an inner chamber of the bush 15, and from here it passes through air passages, sealed by ring gaskets, into the shaft 17 and arm 39, and from this to the cylinder 28.

The swing of the plate 41, under the control of the cylinder 28, is limited by the adjustable setscrew 57, against which the appendix 58 of the plate 41 rests.

In the embodiment shown in FIGS. 3 and 5 an appendix 44, terminating in the form of a spatula 45, is fixed to the plate 41, possibly in an interchangeable manner.

A reel of tape 46 is mounted on a hub rotatable about a pivot rigid with the plate 41. Said hub is braked by the disc 47, the braking action of which is adjusted by the spring 48 and setting nut 49.

The tape 46 unwinds by passing around the roller 50, mounted freely rotatable at the end of the arm 51, which allows free swing. From the roller 50, the tape 46 passes to the deviation roller 52 mounted on the appendix 44 by means of a pivot perpendicular to the appendix 44. From the roller 52, the tape finally passes between the rollers 53 and 54 (FIG. 5) the axes of which are perpendicular to the axis of the roller 52. Along this path the tape 46 undergoes a 90° twist about its longitudinal axis, which, if the distance of the roller 52 and the roller 53 is suitably proportioned to the width of the tape, is not difficult to produce. Normally for tapes having a width less than 12–13mm the distance between the rollers 52 and 53 may be kept sufficiently small, for example 5–6cm, so as to definitely lie within the maximum desirable transverse bulk, in relation to the other turret stations of the coil winder.

The tape 46 which passes about the roller 52 is firmly held between the rollers 53 and 54. The roller 54 has an indented surface and is mounted rotatable about a pivot supported by the appendix 44, while the roller 53 is mounted on a pivot supported by the arm 55, which swings on a support 44' of the appendix 44. A spring 56 is fixed to the arm 55, its other end being fixed to the appendix 44, and its action causes the roller 53 to press on the periphery of the roller 54, so clamping the tape 46. This latter also slides under the spatula 45 which guides it into contact with the lateral surface of the coil B.

To prevent accidental backward sliding of the tape 46, one of the deviation rollers, for example the roller 54, may be mounted rotatable on its own pivot by a free wheel mechanism, which prevents its backward rotation. The clamping of the tape between the rollers 53 and 54 also prevents the tape slipping out.

With the appendix 44 is also associated the pressure roller 59, mounted freely rotatable at the end of a swinging arm 60. This latter is subjected to the action of the return spring 61 which tends to rotate it in the clockwise direction (with respect to FIG. 5) in order to keep it in the position shown, with the appendix 60' in contact with a tooth of the appendix 44.

A ring gear 24, with axial toothing facing downwards, rotates rigidly with the hub of the reel of tape 46. Below the ring gear 24 there is a microswitch 25, the arm 25*a* of which is forced against the toothing of the ring gear 24. When the ring gear 24 rotates, together with the reel of tape 46, said toothing transmits swinging movements to the arm 25*a*, which alternately open and close the micro-switch 25 for the purpose which will be indicated hereinafter.

Lastly, the entire unit carried by the plate 41 is mounted on the pivot 40 adjustable axially by means of the adjustment nut 62, opposed by the spring 63.

The further embodiment shown in FIGS. 4 and 6 has been designed particularly to allow the use of tapes which are wider crosswise, or more rigid, or generally cannot undergo the aforementioned axial twisting in the small space between the roller 52 and the rollers 53–54.

This embodiment differs from that shown in FIGS. 3 and 5 essentially in the configuration of the means for guiding the tape from the roller 50 to the coil B. In this case the appendix 44A is disposed perpendicular to the plane of the plate 41, i.e., substantially parallel to the plane of the tape 46 in its feed path between the roller 50 and said guiding means.

These guiding means also consist of a simple cylinder 65 supported in a fixed manner at its ends on two lugs 66 of the appendix 44A, this cylinder 65 being disposed with its axis at 45° to the feed direction of the tape arriving from the roller 50, or more generally, perpendicular to the bisecting line of the angle formed between the tape approaching and leaving cylinder 65.

With this arrangement, the tape 46 originating from the feed reel is applied to the oblique surface of the cylinder 65, along a generating line forming an angle of 45° with the feed direction of the tape. As it winds on the surface of the cylinder 65, the tape 46 follows a helical path, with a 45° inclination, which enables the tape — after one half of a turn — to withdraw from the cylinder 65 in a direction substantially at 90° to the aforementioned feed direction.

It is evident from the drawing that as the tape undergoes no axial twist in the arrangement shown in FIGS. 4 and 6, there are no problems or limitations with regard to dimensions, and in particular the width, of the tape used.

The embodiment shown in FIGS. 4 and 6 also includes a simplified system for guiding the tape at its point of application to the coil B. This system comprises a spatula 67 which, instead of being rigid with the appendix 44A as in the case of the spatula 45 of the appendix 44, is freely swingably mounted at 68 on the appendix 44A. In the rest position, the spatula 67 rests on the support arm 69, projecting rigidly from the appendix 44A, by the force exerted by the leaf spring 70. The tape 46 passes between the spatula 67 and arm 69 and is normally held between these two elements.

In the working position, when the plate 41 moves the appendix 44A close to the coil B, the tape 46 is pressed against the periphery of the coil B by the end of the spatula 67, this latter being then slightly raised, by the opposing thrust of the coil B and against the action of the spring 70, so as to enable the tape 46 to slide freely.

The two guide systems for the tape applied to the coil B, i.e. with the rollers 53 and 54 and fixed spatula 45 (in accordance with FIG. 5) or with the swinging spatula 67 (in accordance with FIG. 6), do not necessarily relate to the respective embodiments of FIG. 5 or FIG. 6, but may be used either with the roller 52 or with the roller 65.

The spatula 45 or 67 for applying the tape 46 may be of metal, of plastics material of the nylon type, or of any other suitable material, possibly with its resting edge of felt, according to the type of tape 46 to be applied.

The roller 59 for pressing the tape on the periphery of the coil B will also generally be provided in the embodiment shown in FIG. 6, but has not been shown.

From the description given heretofore, particularly with reference to FIGS. 3 and 6, it is evident that the fundamental advantage of the device according to the invention derives from the fact that the tape 46 unwinds in a direction perpendicular to the axis of the coil B only during the first very short path between the application spatula 45 or 67 and the roller 52 or 65, whereas from these latter to the feed roll, or the roller 50, the tape unwinds along a second path substantially parallel to the axis of the coil B and withdrawing from it, i.e., a path which may be of any length, radial to the main axis of the coil winding machine. It follows therefore that the transverse bulk of the device, particularly in the most critical position, i.e., close to the point of application of the tape on the coil, is reduced to a minimum, whereas at the same time the elements of a larger bulk, such as the roll of tape itself and all other means for controlling rotation, may be moved to the outside of the machine because of said second path of the tape, without any limitation, and as far as is necessary in relation to the space available.

The device according to the invention also comprises a system for locking the beginning of the tape 46 on the periphery of the coil B. This system, in the arrangement shown diagrammatically in FIG. 1, comprises a pneumatic cylinder 71 mounted on a support bracket 37, projecting upwards from and fixed to the arm 1 of the machine M by the clamp 38. The lower end of the rod 72 of the cylinder 71 is provided with a small pad 73, and can assume two positions: a raised rest position, indicated by full lines, and a lowered working position indicated by dashed lines.

In this latter position, the pad 73 rests on the periphery of the coil B, for the purpose indicated hereinafter.

Finally the device comprises a tape cutting unit, consisting of a blade 35 mounted on the swinging arm 34 (FIGS. 1 and 7), this latter being pivoted at 36 to the bracket 37. The arm 34 is made to swing by the pneumatic cylinder 33, one end of which is fixed to the clamp 38 and the other end to the lever **34*a*, keyed on to the support pivot for the lever 34**.

When the cylinder 33 is operated, the blade 35 jumps upwards, as indicated by the arrow F″ of FIG. 7, so cutting the tape 46.

The operation of the device heretofore described, with reference to the diagram of FIG. 8, is as follows;

The device is operated with the cam unit in the 0° position by starting the motor 3, which rotates both the pulley 16 and the cam unit 23. The pulley 16 transmits motion to the belt **16*a*, and this transmits motion to the pulley 16*b*. However motion is not yet transmited to the shaft 17, which is kept locked by the engagement of the latch 31 in the notch of the disc 32, because of the slip of the friction discs 18 and 19**.

The cam 23A, which in the 0° position has its recessed part 23A′ at the roller 13, begins to rotate and immediately raises the roller 13, thus making the arm 12 swing in an anticlockwise direction (with respect to FIG. 2). This swing, which terminates after 23° of rotation of the cam unit, brings the axis of the shaft 17 into coincidence with the axis of the coil B.

All other cams act through corresponding micro switches (indicated diagrammatically at 27) which are respectively opened or closed at predetermined moments, i.e. at predetermined stages of the rotation cycle of cams 23, as indicated hereinafter.

Starting from the 0° position, the cam 23C acts on a microswitch for opening a solenoid valve (not shown) which operates the cylinder 28. Consequently, the lower end of the rod of the cylinder 28 presses on the plate 41 and causes it to swing about the pivot 40, against the action of the spring 42. This swing, which is stopped when the appendix 58 of the plate 41 rests against the adjustment screw 57, moves the free end of the spatula 45 or 67 against the periphery of the coil B, so making the tape 46 adhere to the coil.

Immediately after the approach of the spatula 45 or 67 to the periphery of the coil, the cam 23J operates the cylinder 71 by means of a corresponding microswitch and solenoid valve. The rod 72 then rapidly descends to bring the pad 73 against the periphery of the coil B.

The arrangement of the cylinder 71 is such that the pad 73 is applied to the periphery of the coil B exactly in the position in which the beginning of the tape 46 has already been applied by the approach movement of the spatula 45 or 67, the tape projecting beyond the free end of the spatula.

The pressure exerted by the pad 73 is such that the beginning of the tape 46 is strongly applied and held locked on the coil B. Thus any danger of the tape 46 accidentally leaving the coil B and making the subsequent taping operation impossible, is avoided.

When the device has been set in this manner and the tape positioned on the coil B, the taping stage can begin.

For this purpose, at the 23° position, the cam 23D energises the magnet 29 by way of a corresponding microswitch, and consequently the latch 31 is disengaged from the stop notch on the disc 32. The pivot 17 is now free to rotate, and, driven by the pulley **16*b* by means of the belt 16*a*, which is always moving, can rotate the plate 41** and the elements supported on it about the axis of the coil B.

During this rotation, which takes place in the clockwise direction with respect to FIGS. 3 or 4, the tape 46, the beginning of which is held, as stated, against the coil B by the pad 73, is progressively applied around the whole of the periphery of the coil B.

During rotation of the unit, the spatula 45 or 67 constantly presses the tape 46 against the periphery of the coil B, to which it is consequently made to adhere firmly.

When the tape has been wound through about one half of a turn on the coil B, and is thus firmly anchored on the coil periphery, the cam 23J moves the cylinder 71 backwards, so returning the pad 73 to its raised rest position. In this latter position the lower end of the pad 73 is outside the circular trajectory of the appendix 44 or 44A about the axis of the coil B.

The shaft 17 and the unit 41, 44 can thus make a complete turn about the coil B, the whole periphery of which is thus wound with a layer of tape. This complete turn finishes at the 160° position of the cam unit, when the unit 41, 44 has again reached the position shown in FIGS. 3 or 4. At this moment, the latch 31, which had been released by the deenergised electromagnet 29, returns to engagement with the notch of the disc 32, so locking the unit 41, 44.

At this point, the machine operation takes place in one of two different ways, according to whether a single layer of tape is to be wound on the coil B, or a number of layers respectively.

Where only one layer is to be wound, when the 160° position is reached, the unit 41, 44 has practically terminated the tape application stage. Consequently, starting from this 160° position and until the 172° position, the cam 23A again operates, using a second peripheral cavity (not shown), to swing the arm 12 in the clockwise direction, aided by the spring 41. The unit 41,44 is thus withdrawn from the coil B by an amount, determined by the depth of said second cavity in the cam 23A, sufficient to allow the tape cutting means to act. This amount is indicated diagrammatically in FIG. 7 by the distance between the coil B and the end of the spatula 45.

At the 172° position, the cam 23E operates the cylinder 33 by means of the corresponding microswitch and solenoid valve. This causes the arm 34 to rotate with a jerk and the knife 35 to rise, this latter then cutting the tape 46.

The operation comprising the raising of the cutting knife 35 and the return of the knife 35 to its rest position terminates at the 194° position. At this moment a portion of tape freely projects from the periphery of the coil B in an approximately tangential direction.

In this 194° position, the cam 23C returns the cylinder 28 to its rest position, so causing the plate 41 to rotate about the pivot 40 (in the clockwise direction with respect to FIG. 2) under the return action of the spring 42. Simultaneously, the cam 23A acts on the roller 13 to again swing the arm 12 in the anticlockwise direction, and thus return the unit 41, 42 close to the coil B. On termination of these two swing movements, i.e., at the 223° position, the appendix 44 or 44A is thus again close to the coil B, but in a higher position, so that the roller 59 now rests from below against the coil B, instead of the spatula 45 or 67.

While the roller 59 remains firmly resting on the periphery of the coil B, aided by the thrust produced by the spring 61, the cam 23G acts with an operation analagous to that of the cam 23D, and again energises the electromagnet 29, which releases the latch 31 from the notch in the disc 32. The unit 41, 44 is consequently again free to rotate about the coil B.

During this further rotation, the roller 59 presses the tape 46, and particularly the end portion of it which projected tangentially after the tape was cut, against the periphery of the coil, on which the tape consequently remains firmly and finally applied.

This pressing stage terminates when the unit 41, 44 has again made a complete turn, and is again locked by the engagement of the latch 31 in the notch of the disc 32.

After this, the cam 23A makes the arm 12 perform its final swing, in the clockwise direction towards the rest position, and this swing terminates in the 360° position of the cam unit.

In this 360° position, the cams 23B and 23F also operate. The purpose of the cam 23B is to interrupt the current supply to the entire taping unit, by means of a corresponding microswitch, so as to safely stop its operation. The purpose of the cam 23F is to supply, by way of a respective microswitch, a signal indicating "termination" of the taping operation, and "consent" to the further advancement of the turret of the coil winding machine. This latter, because of the fact that in its rest position the unit 41, 44 is sufficiently far from the coil trajectory, can then undergo its normal advancement to withdraw the coil of which the tape has already been wound and bring into position a coil on which the tape has yet to be applied.

If a plurality of superimposed layers of tape are to be applied to the coil, instead of a single layer of tape as above, the operation, starting from the 160° position, is as follows:

Firstly the cam 23H acts in order to energise the electromagnetic unit 11, by way of its own microswitch. This moves the shaft **6*a*, inside the shaft 6, in the direction of the arrow F'. By means of this movement, the radial pin 9 leaves the notch 22*a* of the drum 22 in which it was engaged and consequently the drum 22 is disengaged from the shaft 6.**

The shaft 6 can thus proceed with its rotation, together with the pulley 16, while the drum 22 stops in the 160° position.

Locking means (not shown because they are of known type) are preferably associated with the drum 22, in order to keep this latter firmly locked in position, against accidental movements, while the electromagnetic unit 11 remains energised.

The cam 23J, which is of the multi-functional type, again intervenes simultaneously with the intervention of the cam 23H for operating the electromagnetic unit 11. In effect, besides operating the cylinder 71, as seen above, the cam 23J also activates a revolution counter (not shown), which counts the revolutions of the unit 41, 44 by means of the microswitch 74, operated by the tooth 75 rigid with the disc 32.

The aforementioned revolution counter forms part of an electronic control unit (not shown) with which it is possible to automatically ensure that the required number of turns of tape 46 are wound on the coil.

Having set the required number of turns on the electronic control unit, the operation is as follows, it being assumed that three turns are required:

The device operates until the 160° position in the manner heretofore described, in order to wind the first layer of tape. Then the electronic control unit comes into operation as the cam unit 23 stops by the action of the cam 23H. While counting takes place, the electronic unit emits a continuous signal for energising the electromagnet 29, the latch 31 being in this way kept disengaged from the notch of the disc 32.

The unit 41, 44 is thus free to continue its rotation, continually applying the tape to the periphery of the coil B, until it has made the set number of turns, this number being counted by the electronic control unit by way of the impulses emitted by the microswitch 74. When said electronic unit has counted a set number of turns, in this case the third turn (including obviously the first turn, made before the 160° position), it interrupts the feed to the electromagnet 29. The latch 31, under the thrust of the respective spring 30, again engages with the notch of the disc 32 as soon as this latter has reached the cycle initiation position, together with the entire unit 41, 44 shown in FIG. 2.

On termination of the set number of turns, the electronic control unit besides deenergising the electromagnet 29 also deenergises the electromagnetic unit 11. The shaft 6*a* consequently returns to its rest position, under the thrust of the spring 10, moving in the direction opposite to the arrow F'. As the shaft 6*a* continues to rotate during this stage, the pin 9 can become inserted into the first of the notches 22*a* which it encounters during its rotation, so again making the drum 22 rigid with the shaft 6. At this moment the unit 41, 44 is in the cycle initiation position, and the cam unit is in the 160° position, these latter thus again being perfectly in phase. The previously described series of operations required for closing the tape, which occur during the stages between 160° and 360°, can take place.

It is evident that the system heretofore described for locking the cam unit in the intermediate 160° position, while the unit 41, 44 continues to wind the tape on the coil, separates the problem of phasing the movements of the various working parts of the machine from the problem of determining the number of turns of winding, in that the machine cycle is locked in the intermediate 160° position until the set number of turns has been made.

A further important function of the device described is that of safety, obtained by cooperation between the rack 24 and microswitch 25. As stated, while the reel of tape 46 rotates, indicating that the tape is correctly fed, the rack 24 also rotates, which alternately opens and closes the microswitch 25 to feed a succession of impulses to the said electronic unit These impulses make the electronic circuit produce a consent signal for the rotation of the motor 3. This signal is however interrupted and consequently the motor 3 is locked together with the entire device, when said impulses from the microswitch 25 are missing. This lack of impulses is an indication that the reel of tape has stopped, for example because of breakage or lack of tape, and in any case is a sign of lack of application of the tape to the coil.

The invention is not limited to the particular embodiments described, and various modifications may be made to them, particularly with regard to the different stages of operation described with reference to FIG. 8, without departing from the scope of the invention itself.

I claim:

1. A coil winding machine comprising in combination a stepwise rotating table and a plurality of supports distributed about the periphery of the rotating table, each support carrying at least one coil core, and means for applying and winding a discrete length of insulating adhesive tape on the periphery of a coil wound on each said core, said means comprising:

a support plate, means mounting the support plate on the machine for rotation about the axis of a said wound coil, and a reel of feed tape mounted freely rotatable on said support plate;

means mounted on the machine for causing said support plate to oscillate from a rest position, away from the wound coil, to a working position in proximity to said coil;

first guide means, mounted on said support plate in such a position that, with the support plate in said working position, said guide means is closely adjacent said wound coil, said first guide means guiding said tape in a plane parallel to the axis of said coil;

second guide means, disposed at a short distance from the first guide means and also mounted on said support plate, the tape running between said first and said second guide means along a first path substantially perpendicular to the axis of the wound coil, said tape running also between said second guide means and said reel, along a second path substantially parallel to the axis of the said coil;

means mounted on the machine for retaining the free end of the tape against the periphery of the wound coil; means actuating the last-named means when the winding of said tape starts;

means mounted on the machine for cutting off said discrete length of the tape; and means actuating the lastnamed means after the winding of at least one turn of tape.

2. Device as claimed in claim 1, in which said second guide means consist of an idle roller with its axis perpendicular to the coil axis, the tape undergoing a 90° twist along its axis during said path between the first and second guide means.

3. Device as claimed in claim 1, in which said second guide means consist of a fixed, at least partially cylindrical surface, the axis of which is positioned substantially perpendicular to the bisecting line of the angle formed between the direction of sliding of the tape along said first and along said second path, along these paths the tape sliding on flat surfaces.

4. Device as claimed in claim 3, in which said second guide means consist of a fixed cylinder with a surface having a low coefficient of friction, on which the tape slides, winding up by at least one-half of a turn along a helical path.

5. Device as claimed in claim 4, in which said helical path is inclined at 45° .

6. Device as claimed in claim 1, in which said first guide means consist of a pair of rollers with their axes parallel to the axis of the coil, adjacent one to the other, and between which the free end of the tape is held.

7. Device as claimed in claim 1, comprising a swinging support arm mounted on the machine and arranged to support said rotating support of the reel of tape, and means mounted on the machine to swing said arm between a rest position, in which it is withdrawn from the coil on which the tape is to be wound, and a working position in which it brings said first guide means close to the coil.

8. Device as claimed in claim 1, further comprising a pad arranged to hold the beginning of the tape to be wound on the coil, said pad being carried by means for exerting a pressure on the coil periphery.

9. Device as claimed in claim 8, in which said pressure exerting means consist of a pneumatic cylinder the rod of which carries said pad at its free end.

10. Device as claimed in claim 1, in which said cutting means comprises a knife which moves with a jerk towards the tape to be cut, under the control of a pneumatic cylinder.

11. Device as claimed in claim 1, in which a circular rack or ring gear is associated with said reel of tape so that it rotates rigidly with it, and co-operates with a fixed microswitch for transmitting, during its rotation caused by the unwinding of the tape from the reel, a succession of electrical impulses corresponding to the alternate opening and closing actions of the microswitch, said succession of impulses being used in an electronic control circuit as an indication of correct tape feed.

* * * * *